US007874288B2

(12) United States Patent
Ito et al.

(10) Patent No.: US 7,874,288 B2
(45) Date of Patent: Jan. 25, 2011

(54) GAS COMBUSTION APPARATUS

(75) Inventors: Shuji Ito, Nagoya (JP); Masakazu Ando, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 703 days.

(21) Appl. No.: 11/606,126

(22) Filed: Nov. 30, 2006

(65) Prior Publication Data

US 2007/0119447 A1 May 31, 2007

(30) Foreign Application Priority Data

Nov. 30, 2005 (JP) ..... 2005-346379

(51) Int. Cl.
*F24H 3/00* (2006.01)
*F24H 9/02* (2006.01)
*F24H 3/06* (2006.01)

(52) U.S. Cl. ..... 126/116 R; 220/378

(58) Field of Classification Search ..... 110/181, 110/173, 341; 126/83, 42, 39 BA, 39 B, 126/116 R; 122/497, 498, 499, 494; 220/378, 220/592.17, 592.16; 62/457.1–457.7, 463, 62/465, 466, 459

See application file for complete search history.

(56) References Cited

U.S. PATENT DOCUMENTS 6,609,908 B2 * 8/2003 Guilmette et al. ..... 432/250

FOREIGN PATENT DOCUMENTS

| | | | |
|---|---|---|---|
| JP | 60-213768 A | | 10/1985 |
| JP | 06-281259 A | | 10/1994 |
| JP | 08-121876 A | | 5/1996 |
| JP | 08121876 A | * | 5/1996 |
| JP | H-10-73326 A | | 3/1998 |
| JP | 10-300237 A | | 11/1998 |
| JP | 10300237 A | * | 11/1998 |

* cited by examiner

*Primary Examiner*—Kenneth B Rinehart
*Assistant Examiner*—Chuka C Ndubizu
(74) *Attorney, Agent, or Firm*—Fitch, Even, Tabin & Flannery

(57) ABSTRACT

An outer case 10 accommodating a gas combustion apparatus main body comprises a case main body 2 opening forward, and a front cover 3 closing a front end opening of the case main body 2. A waterproof packing material 17 is sandwiched between inner peripheral flanges 20 and 39 formed on inner peripheral edges of the front end opening of the case main body 2 and a rear end of the front cover 3. To deteriorate outward appearance and cleaning easiness of a connected portion between the front cover 3 and the case main body 2, and to stably secure waterproof of the connected portion for a long term, a protection plate covering a range extending along an upper edge of a front end opening of the case main body 2 of the packing material 17 is possessed to the front cover 3 or the case main body 2.

6 Claims, 7 Drawing Sheets

PRIOR ART

PRIOR ART

GAS COMBUSTION APPARATUS

This Application is a U.S. Utility Patent Application which claims foreign priority from Japanese Application No. 2005-346379, filed Nov. 30, 2005, the complete disclosure of which is incorporated herein by reference.

BACKGROUND OF THE INVENTION

1. Field of the Invention

The present invention relates to a gas combustion apparatus, and can be applied to a boiler.

2. Disclosure of the Prior Art

A gas combustion apparatus such as a boiler is disposed outdoors in some cases, and when rainwater enters an outer case thereof, there is a fear that a malfunction occurs in a combustion portion or an electrical component apparatus. Therefore, the gas combustion apparatus generally has a waterproof structure for preventing rainwater from entering the outer case.

FIG. 6 is a schematic vertical sectional view of a conventional boiler 1 as the gas combustion apparatus.

The boiler 1 includes a boiler main body 1A. An air supply fan 12 disposed in a lower portion of an outer case 10, a combustion unit 11 incorporating a gas burner therein, a heat exchange unit 13, an exhaust collector 14 and an exhaust cylinder 15 are connected to one another in this order in an upper portion of the boiler main body 1A.

The outer case 10 includes a case main body 2 accommodating the boiler main body 1A therein, and a front cover 3 for covering an opening formed in a front surface of the case main body 2. An exhaust cylinder insertion opening 300 is formed in the front cover 3, and the exhaust cylinder 15 of the boiler main body 1A projects outside from the exhaust cylinder insertion opening 300.

The front cover 3 has an outer peripheral flange 3*a* projecting toward a rear end peripheral edge. The outer peripheral flange 3*a* is superposed on an outer peripheral flange 2*a* projecting toward a front end peripheral edge of the case main body 2 and is fixed thereto by means of a screw.

Therefore, even when the boiler 1 disposed outdoors is exposed to rain, rainwater which fell on the upper surface of the case main body 2 or the front cover 3 is held back by the outer peripheral flanges 2*a* and 3*a* and does not enter the outer case 10, and adverse influence on the inside boiler main body 1A and electrical component apparatus 16 is avoided.

According to the conventional technique shown in FIG. 6, however, outward appearance of the boiler 1 is deteriorated due to the overhanging outer peripheral flanges 2*a* and 3*a* from the case main body 2 and the front cover 3, a dust cloth used at a time of cleaning is caught in the outer peripheral flanges 2*a* and 3*a* and this hinders cleaning operation.

FIG. 7 shows another conventional technique capable of solving this problem.

According to this technique, an inner peripheral flange 20 formed on a peripheral edge of a front end opening of the case main body 2 and an inner peripheral flange 39 formed on the rear end peripheral edge of the front cover 3 are fixed to each other by means of a screw (not shown) through a packing material 17. According to this technique, the packing material 17 prevents rainwater from entering from a connected portion between the case main body 2 and the front cover 3, and there are no members corresponding to the outer peripheral flanges 2*a* and 3*a* hanging over the outer peripheries of the fitted portion between the front cover 3 and the case main body 2 unlike the conventional technique shown in FIG. 6 and thus, the outward appearance of the boiler 1 is not deteriorated and the cleaning operation can smoothly be carried out.

According to the boiler shown in FIG. 7, however, the packing material 17 is simply sandwiched between the inner peripheral flange 20 and opposite inner peripheral flange 39 of the case main body 2 and the front cover 3, respectively, and the outer periphery of the packing material 17 is exposed to outside. Therefore, the packing material 17 is exposed to the natural environment such as sunlight and rainwater. Thus, there is a problem that the packing material 17 is deteriorated with time and the waterproof is prone to be deteriorated.

According to the conventional boilers, the two requirements, i.e., a requirement of outward appearance and cleaning easiness of the connected portion between the case main body 2 and the front cover 3, and a requirement of the waterproof lasting for a long term can not be satisfied at the same time.

SUMMARY OF THE INVENTION

In a gas combustion apparatus having an outer case 10 accommodating a combustion apparatus main body therein, in which the outer case 10 comprises a case main body 2 of rectangular box shape with a front side opened, and a front cover 3 for closing a front end opening of the case main body 2, a waterproof packing material 17 is sandwiched between an inner peripheral flange 20 formed on an inner peripheral edge of the front end opening of the case main body 2 and an inner peripheral flange 39 formed on an inner peripheral edge of a rear end of the front cover 3, it is an object of the present invention not to deteriorate outward appearance and cleaning easiness of a connected portion between the front cover 3 and the case main body 2, and to stably secure waterproof of the connected portion for a long term.

To achieve the above object, the gas combustion apparatus of a first invention is characterized in that a protection plate which covers from above a range extending along an upper edge of the front end opening of the case main body 2 of the packing material 17 is possessed to the front cover 3 or the case main body 2.

The packing material 17 in the region extending along the upper edge of the front end opening of the case main body 2 is covered with the protection plate from above and is not exposed to outside.

Therefore, the packing material 17 is less prone to be exposed to sunlight, wind and rain. Deterioration of the packing material 17 with time is suppressed and thus, the waterproof can stably be secured for a long term.

Since rainwater is prevented from entering the portion where the packing material 17 is disposed by the protection plate, the rainwater is sealed twice, i.e., by the protection plate and the packing material 17.

The inner peripheral flange 20 and opposite inner peripheral flange 39 provided on the case main body 2 and the front cover 3 are hidden by the inner periphery of the connected portion of the case main body 2 and the front cover 3. Therefore, the outward appearance is not deteriorated, and a dust cloth used at the time of cleaning is not caught in the connected portion between the front cover 3 and the case main body 2.

The present invention has the above structure, and the following unique effects can be exhibited.

Since the packing material 17 is covered by the protection plate and is not exposed to outside, the packing material 17 is not exposed to sunlight, wind and rain. Deterioration of the packing material 17 with time is suppressed and thus, the waterproof can stably be secured for a long term.

As described above, the connected portion between the front cover 3 and the case main body 2 is sealed twice, i.e., by the packing material 17 and the protection plate which covers the packing material 17. Thus, waterproof is enhanced.

The inner peripheral flange 20 and opposite inner peripheral flange provided on the case main body 2 and the front cover 3 are hidden by the inner periphery of the connected portion of the case main body 2 and the front cover 3. Therefore, the outward appearance is not deteriorated, and a dust cloth used at the time of cleaning is not caught by the flanges.

Although the protection plate can be possessed to the case main body 2, it also can be possessed to an upper edge of the front cover 3, and a tip end of the protection plate can be superposed on an upper surface of the case main body 2 as in a second invention.

According to a third invention, in each of the first and second inventions, an inner side of the front cover 3 is provided with a drainage receiver opening upward and having a drainage hole at an lower end thereof, a visor member with slant posture to descend towards front is established above the drainage receiver and below a range extending along the upper edge of the front end opening of the case main body 2 of the packing material 17, and a dripping water from the visor member drops into the drainage receiver.

Even when rainwater enters from the portion where the packing material 17 is disposed and the rainwater drops on the visor member, the rainwater flows to the front end of the forwardly inclining visor member, drops on the drainage receiver opening upward provided below the visor member, and then, is discharged outside from the drainage hole formed in the lower end.

According to this invention, even when rainwater enters from the portion where the packing material 17 is disposed, the rainwater drops into the drainage receiver from the visor member to be collected. Therefore, it is possible to more reliably protect the combustion apparatus main body and the electrical component apparatus in the outer case 10 against rainwater entering from the portion where the packing material 17 is disposed.

According to a fourth invention, in the third invention, the visor member is detachably inserted into the front end opening of the case main body 2. Therefore, the assembling operation of the visor member is completed only by inserting the visor member from the front end opening of the case main body 2. Thus, the visor member can easily be assembled.

Other object, features, aspects and advantages of the invention will become more apparent from the following detailed description off embodiments with reference to the accompanying drawings and appended claims.

DETAILED DESCRIPTION OF THE EMBODIMENT

Next, the best mode for carrying out the above present invention will be explained in detail with reference to the accompanying drawings.

Figure 1:
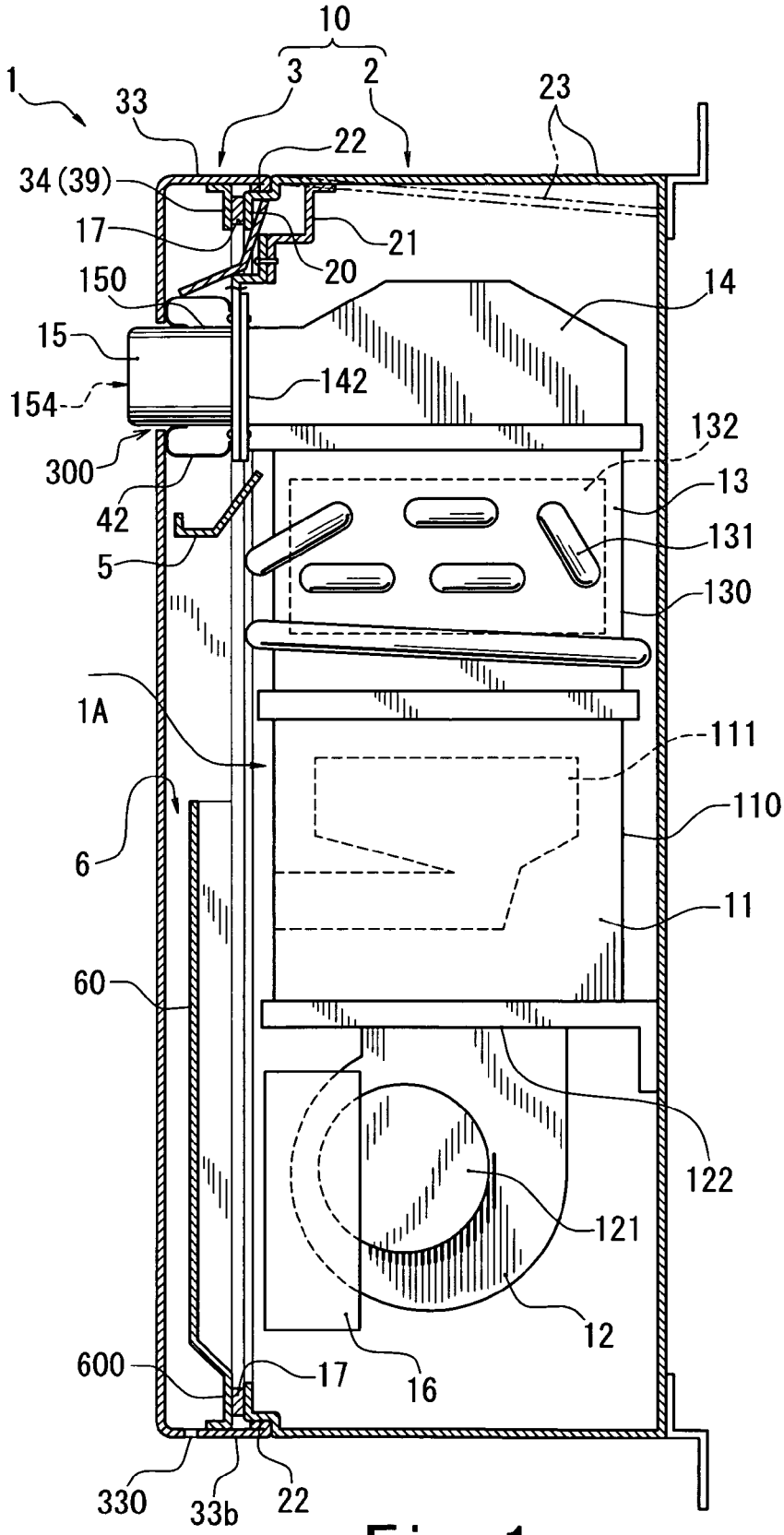
FIG. 1 is a sectional view of a boiler 1 according to an embodiment of the present invention.
Figure 2:
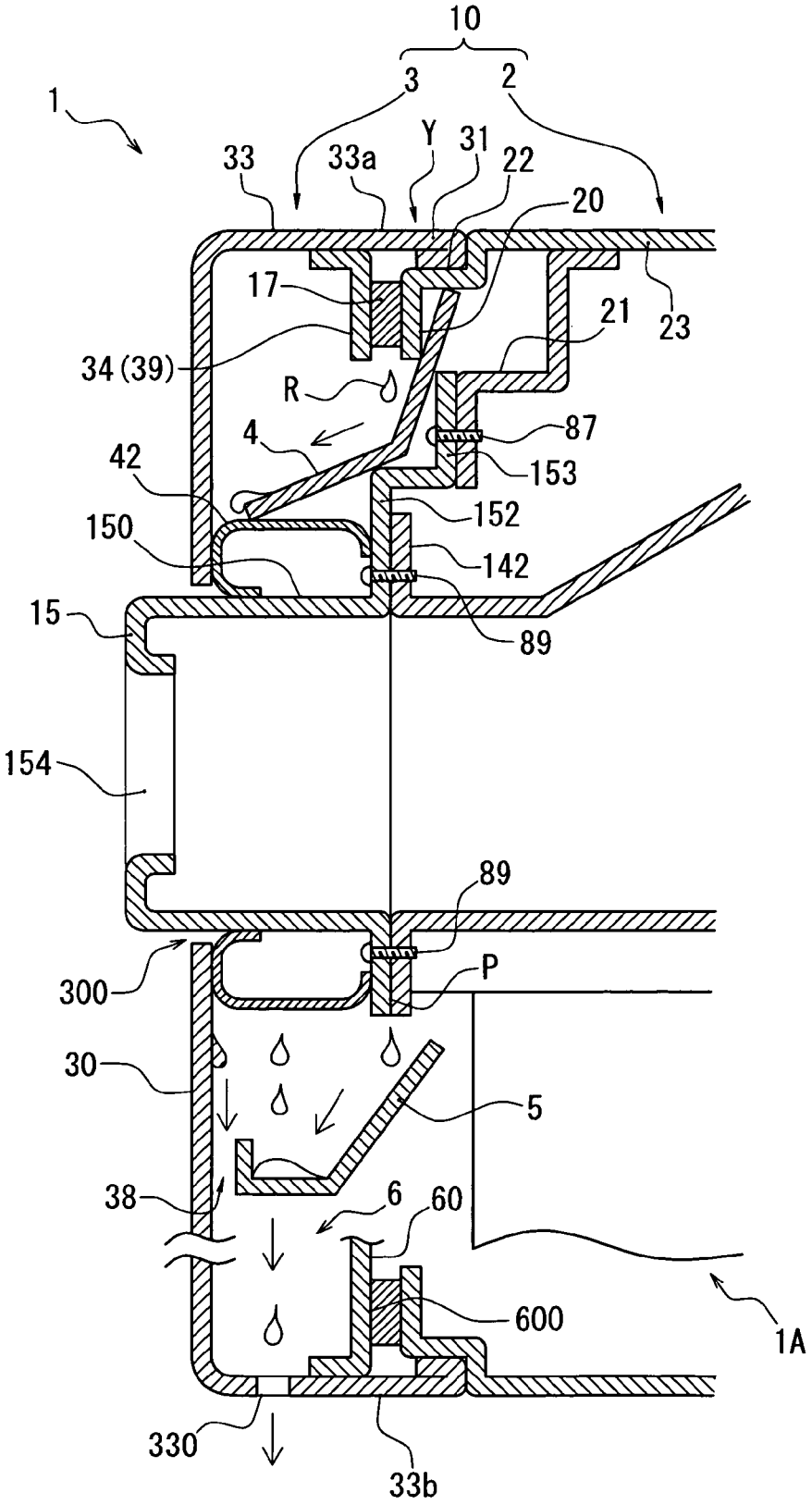
FIG. 2 is an enlarged sectional view of an essential portion of the boiler 1 in FIG. 1.

FIG. 1 is a schematic vertical sectional view of a boiler 1 as an example of the gas combustion apparatus according to an embodiment of the present invention; FIG. 2 is an enlarged view of a front of an upper portion thereof, and FIG. 3 is an exploded perspective view thereof.

Figure 3:
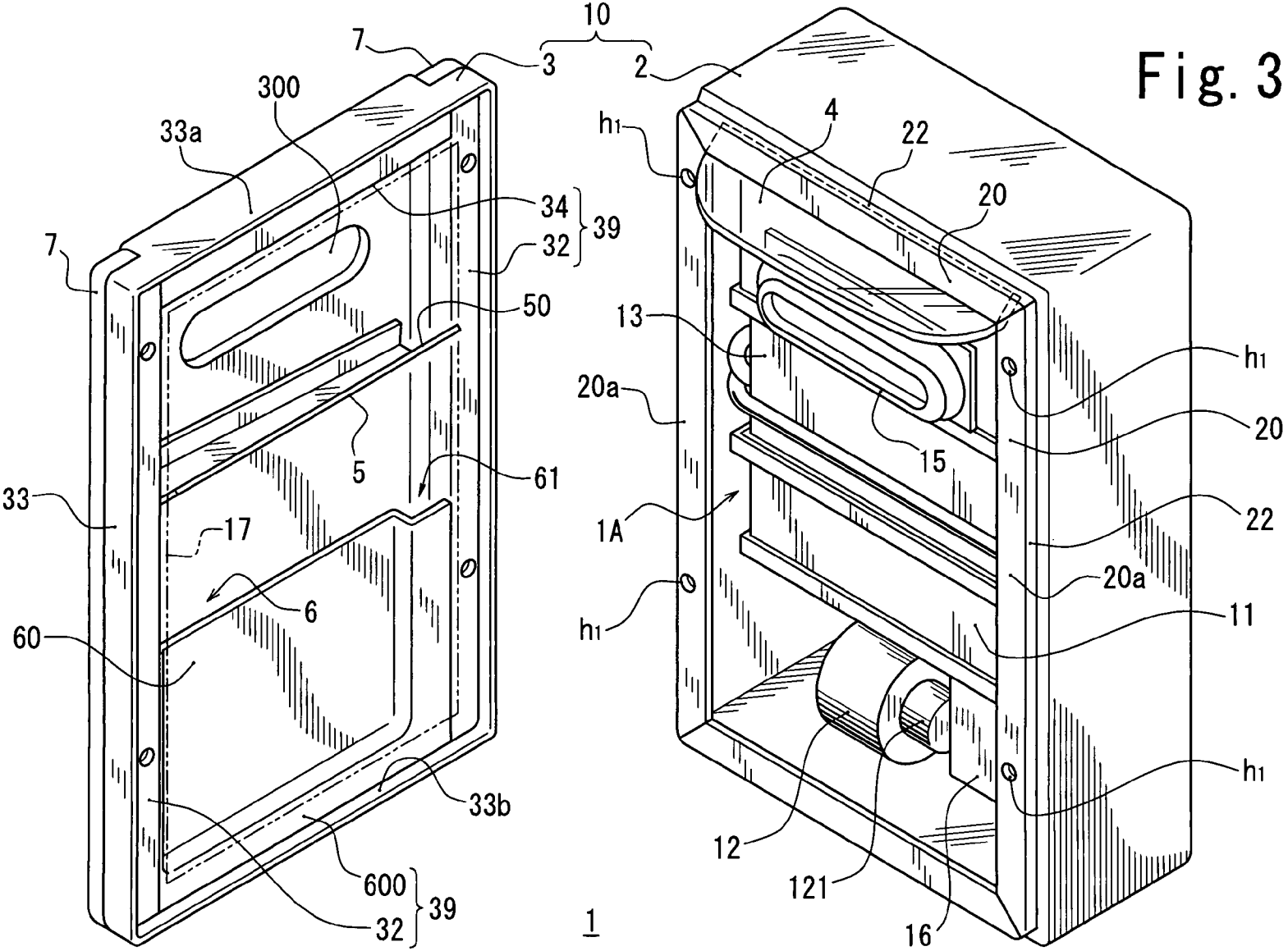
FIG. 3 is an exploded perspective view of the boiler 1 according to the embodiment of the invention.

As shown in FIGS. 1 and 3, the boiler 1 comprises an outer case 10 of rectangular box shape, a boiler main body 1A as a combustion apparatus main body accommodated in the outer case 10, and an electrical component apparatus 16.

An air supply fan 12 disposed at a lower portion in the outer case 10, a combustion unit 11 incorporating a gas burner therein, a heat exchange unit 13, an exhaust collector 14 and an exhaust cylinder 15 are connected to one another in this order in an upper portion of the boiler main body 1A.

The air supply fan 12 includes a fan motor 121. The air supply fan 12 has a discharge opening 122 connected to the combustion unit 11 above the discharge opening 122. Combustion air is forcibly supplied into the combustion unit 11 by the operation of the fan motor 121.

The combustion unit 11 has a rectangular combustion box 110 whose lower end is connected to the discharge opening 122 of the air supply fan 12, and a gas burner 111 is accommodated in the combustion box 110. Gas is supplied into a gas inlet of the gas burner 111 from a gas nozzle (not shown).

The heat exchange unit 13 has many parallel endothermic fins 132 heated by combustion gas from the combustion unit 11, and an endothermic pipe 131 passing through the endothermic fins 132. A lower end opening of a rectangular frame body 130 surrounding the endothermic pipe 131 is connected to an upper end opening of the combustion box 110 constituting the combustion unit 11.

An upstream end of the endothermic pipe 131 is connected to a water pipe (not shown), and a downstream end of the endothermic pipe 131 is connected a hot water pipe (not shown) connected to a bathtub or a hot water faucet.

The exhaust collector 14 is a box-like body whose lower end and front end are opened. The lower end opening is connected to an upper end of the rectangular frame body 130 of the heat exchange unit 13.

The exhaust cylinder 15 is connected to the front end of the exhaust collector 14. More specifically, as shown in FIG. 2, an outer peripheral flange 142 hangs over from the peripheral edge of the front end opening of the exhaust collector 14, and an outer peripheral flange 152 hangs over from the peripheral edge of the rear end opening of the exhaust cylinder 15. The outer peripheral flange 152 comes in contact with the outer peripheral flange 142 and connected to each other through screws 89 and 89.

An annular packing material 42 is sandwiched between the outer peripheral flange 152 and the later-described front cover 3 of the outer case 10, and the annular packing material 42 is fitted around a body 150 of the exhaust cylinder 15. The annular packing material 42 prevents permeation of rainwater from the exhaust cylinder insertion opening 300 formed in the front cover 3.

As shown in FIGS. 1 and 3, the outer case 10 includes a case main body 2 accommodating the boiler main body 1A and the electrical component apparatus 16, and the front cover 3 covering the front end opening of the case main body 2.

The case main body 2 is formed into a rectangular box which is opened forwardly. A gradation portion 22 fitted into the front cover 3 is provided around the front end opening of the case main body 2. The front end edge of the gradation portion 22 is bent inward to form the inner peripheral flange 20, and a plurality of screw holes h1 for fixing the front cover 3 are formed near upper end lower ends of a pair of vertical sides 20*a* of the inner peripheral flange 20.

As shown in FIG. 2, a support plate 21 extending from a top plate 23 downwardly is provided inside of an upper portion of the case main body 2. The support plate 21 is connected and fixed, through a screw 87, to a connecting piece 153 extending from an outer peripheral flange 152 of a base end of the exhaust cylinder 15.

A visor member 4 is detachably attached to an upper portion of the front end opening of the case main body 2. The visor member 4 is formed by bending a polyester rectangular resin plate at its central portion in its widthwise direction. As shown in FIG. 2, the visor member 4 is inserted between the inner peripheral flange 20 along the peripheral edge of the front end opening of the case main body 2 and the outer peripheral flange 152 of the base end of the exhaust cylinder 15 and in this state, the visor member 4 is placed on the outer peripheral flange 152 or the annular packing material 42. The visor member 4 is located below a later-described waterproof packing material 17 interposed between connected portions of the case main body 2 and the front cover 3. With this, rainwater R entering from the packing material 17 when sealing failure occurs is allowed to flow into upper end lower drainage receivers 5 and 6 disposed inside of the front cover 3.

The front cover 3 covering the front end opening of the case main body 2 is formed by drawing a metal plate into a shape such as a rear opened shallow dish. A rear end 31 of the outer peripheral side plate 33 (corresponding to "protection plate" which is a specified invention matter) is substantially fitted around the gradation portion 22 of the front end outer periphery of the case main body 2. By covering the packing material 17 with the rear end 31 of the front cover 3, the packing material 17 is prevented from being exposed to sunlight, wind and rain. An overlapped portion Y between the rear end 31 of the front cover 3 and the gradation portion 22 of the front end peripheral edge of the case main body 2 prevents rainwater from entering to a portion where the packing material 17 is disposed.

Figure 5:
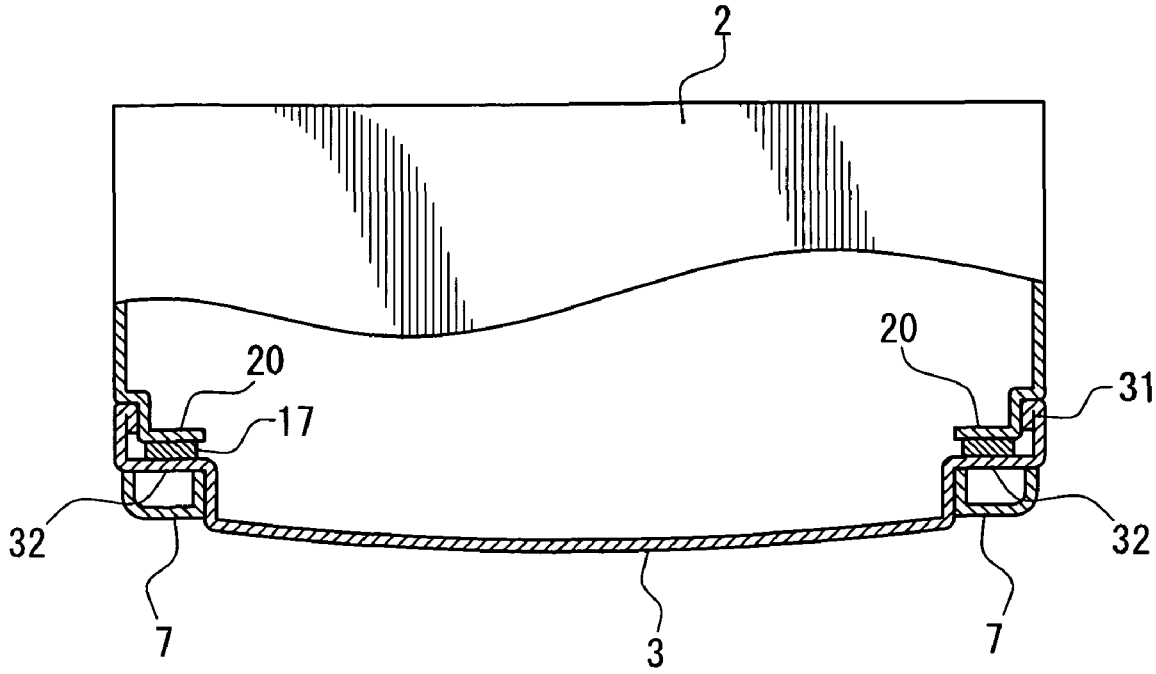
FIG. 5 is a diagram used for explaining a fitted portion between a front cover 3 and a case main body 2.
Figure 6:
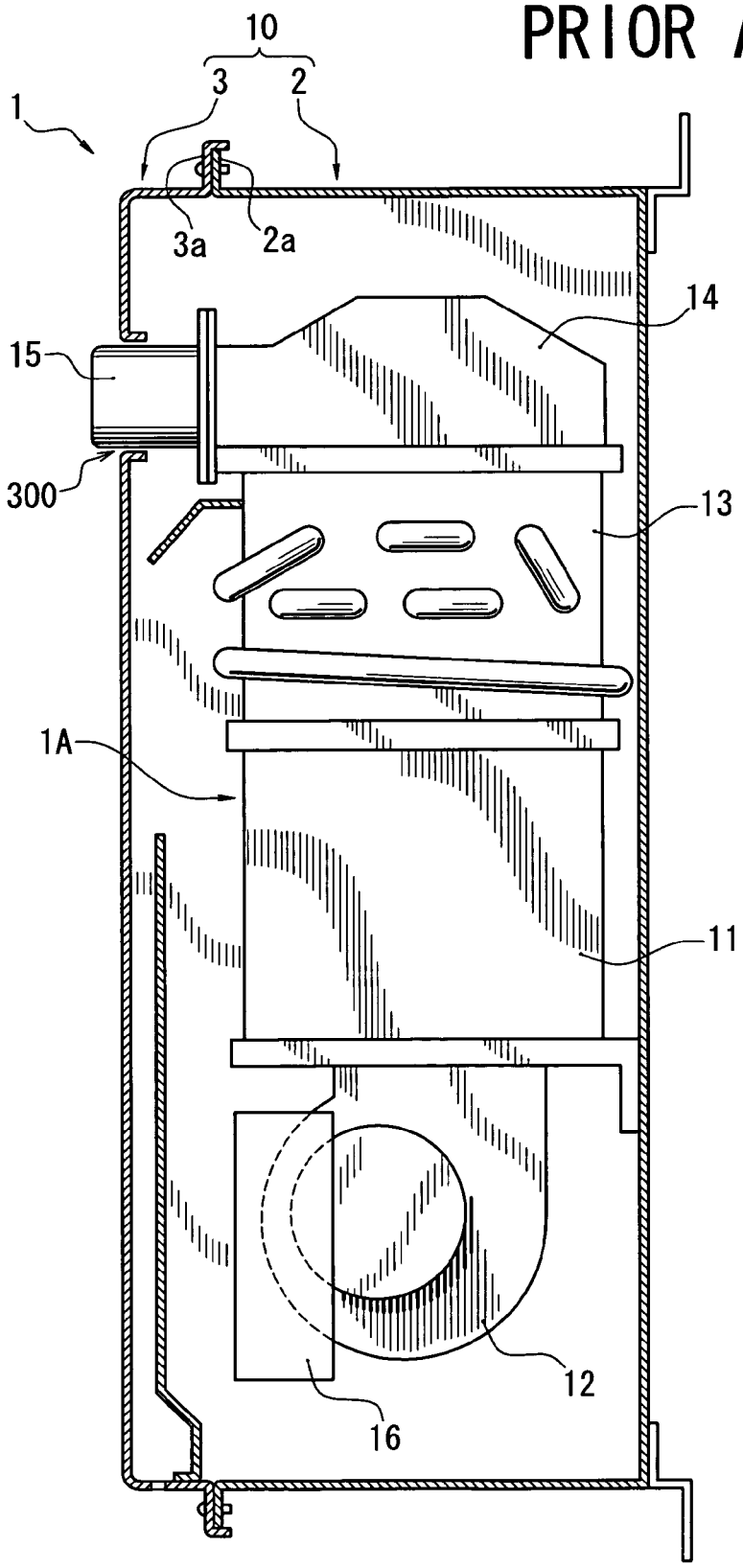
FIG. 6 is a sectional view of a conventional example.
Figure 7:
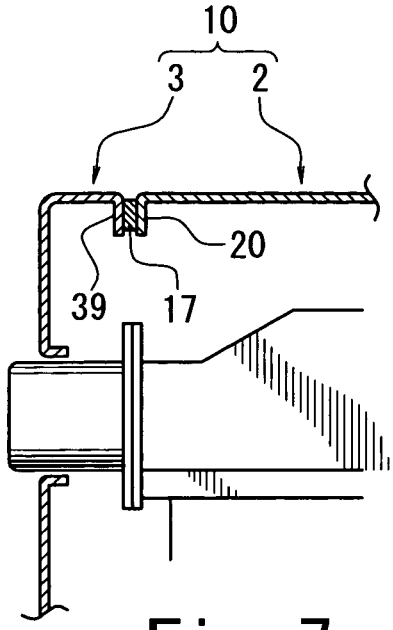
FIG. 7 is an enlarged sectional view of another conventional example.

FIG. 5 is a partially cut-away end view of a fitted portion between the front cover 3 and the case main body 2 as viewed from above.

Steps 32 and 32 into which a dressed cover 7 is fitted are formed on regions extending along both left and right sides of the front cover 3. The dressed cover 7 conceals a fixing screw 86 (see FIG. 4) of the front cover 3. A rear end peripheral edge 31 of the front cover 3 is substantially tightly fitted around the gradation portion 22 formed around the outer periphery of the front end of the case main body 2.

A pendulous flange 34 extending over the left and right entire width of the front cover 3 projects from the lower surface of the upper side portion 33*a* of the outer peripheral side plate 33 of the front cover 3 as shown in FIGS. 2 and 3. A pocket plate 60 stands on an upper surface of a lower side portion 33*b* of the outer peripheral side plate 33 of the front cover 3. A lower drainage receiver 6 is formed between the pocket plate 60 and the cover 3.

The pendulous flange 34 provided on an upper portion of the front cover 3, all ranges of a lower end 600 of the pocket plate 60 provided at a lower portion, and back surfaces of the steps 32 and 32 provided on left and right sides of the front cover 3 are arranged in a form of a rectangular frame as viewed from back side of the front cover 3, and they form the opposite inner peripheral flange 39 for sandwiching the packing material 17. The rectangular frame-shaped packing material 17 is sandwiched between the opposite inner peripheral flange 39 and the inner peripheral flange 20 of the front end peripheral edge of the case main body 2. With this, waterproof at the fitting connecting portion between the case main body 2 and the front cover 3 is secured. Since the inner peripheral flange 20 and opposite inner peripheral flange 39 provided on the case main body 2 and the front cover 3 are hidden under the connecting portion between the case main body 2 and the front cover 3, outward appearance of the boiler 1 is not deteriorated, a dust cloth used at the time of cleaning is not caught in the connected portion.

As shown in FIGS. 1 and 2, a drainage hole 330 for discharging water in the lower drainage receiver 6 is formed in the lower side portion 33*b* of the outer peripheral side plate 33 of the front cover 3. The upper drainage receiver 5 provided above the lower drainage receiver 6 is formed in a form of a gutter whose upper portion is opened. As shown in FIG. 3, rainwater received by the upper drainage receiver 5 drops into an enlarged opening 61 formed in a side of the lower drainage receiver 6 from one drainage end 50 in the longitudinal direction. As shown in FIG. 2, the upper drainage receiver 5 is located below the connected portion P between the exhaust cylinder 15 and the exhaust collector 14 of the boiler main body 1A. A gap 38 through which rainwater flowing along an inner surface of the front plate 30 flows toward the lower drainage receiver 6 is formed between the upper drainage receiver 5 and the front plate 30 of the front cover 3.

Figure 4:
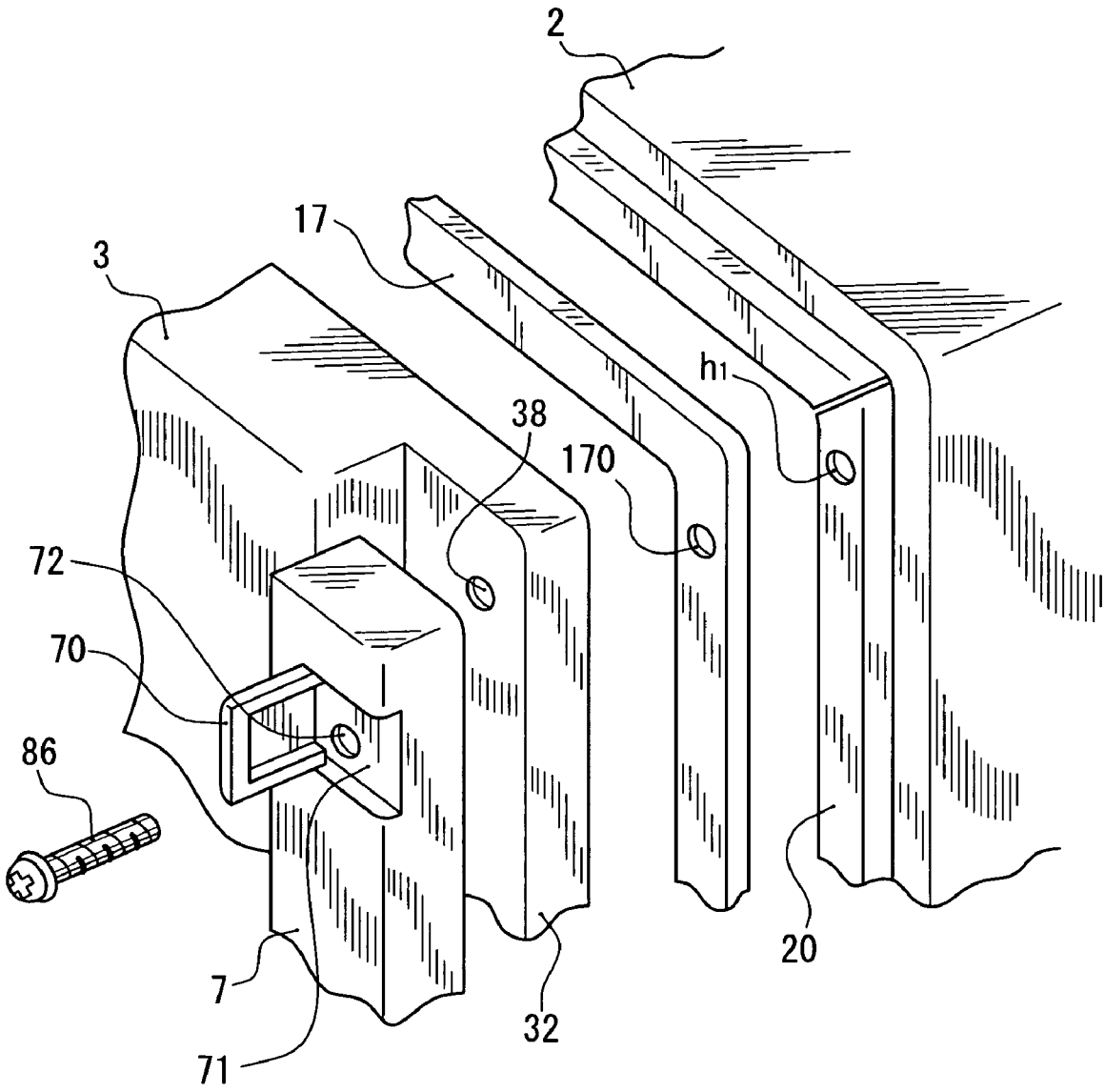
FIG. 4 is an enlarged perspective view of a mounting portion of a dressed cover 7.

As shown in FIGS. 3 and 4, the resin dressed cover 7 extending over the vertical entire range is fixed to the step 32 formed along the both left and right sides of the front surface of the front cover 3 through the screw 86. A recess 71 which is opened and closed by a lid 70 is formed near the upper and lower ends of the dressed cover 7. The screw holes 72 are formed in the bottom of the recess 71. The screw holes 72 are opposed to the through hole 38 formed in the step 32 formed along both left and right sides of the front cover 3, the through hole 170 of the packing material 17 and the screw holes h1 formed in the inner peripheral flange 20 of the case main body 2. Therefore, after the fixing screw 86 passes through the screw holes 72, the through hole 38 and the through hole 170, if the fixing screw 86 is screwed into the screw holes h1, the front cover 3 is mounted on the case main body 2, and the dressed cover 7 is mounted on the front cover 3. Thereafter, if the lid 70 is closed, the fixing screw 86 is concealed.

Next, waterproof function of the packing material 17 provided at the connected portion between the front cover 3 and the case main body 2 will be explained.

When the boiler 1 is exposed to rainwater, the rainwater applied to the connected portion between the case main body 2 and the front cover 3 is blocked by the rear end 31 of the outer peripheral side plate 33 of the front cover 3 and the overlapped portion Y (see FIG. 2) of the gradation portion 22 of the front end peripheral edge of the case main body 2, it becomes difficult for the rainwater to enter the inside packing material 17. Even if the rainwater enters, the rainwater is blocked by the packing material 17 and the connected portion is reliably made waterproof.

When rainwater enters from a portion where the packing material 17 is disposed due to deterioration with time, the rainwater R is received and stopped by the visor member 4 provided at the upper portion of the front end opening of the case main body 2 and is guided forward, and the rainwater R flows along an inner surface of the front cover 3, and is collected by the lower drainage receiver 6 from the drainage end 50 in the longitudinal direction of the upper drainage receiver 5, or flows from the front gap 38 in the upper drainage receiver 5 and is directly collected by the lower drainage receiver 6. Then, the rainwater R is discharged out from the drainage hole 330 formed in the bottom wall of the lower drainage receiver 6.

If rainwater entering an exhaust opening 154 at a tip end of the exhaust cylinder 15 drops into the upper drainage receiver 5 from the combustion portion between the exhaust cylinder 15 and the exhaust collector 14, the rainwater is collected by the lower drainage receiver 6 from the drainage end 50 in the longitudinal direction of the upper drainage receiver 5. With this, the boiler main body 1A and the electrical component apparatus 16 are protected against the rainwater.

According to this structure, the packing material 17 located at the combustion portion between the front cover 3 and the case main body 2 is covered by the rear end 31 of the front cover 3 and is not exposed outside. Therefore, the packing material 17 is not exposed to sunlight, wind and rain easily, the deterioration with time of the packing material 17 is suppressed and thus, the waterproof can be secured stably for a long term.

It becomes difficult for rainwater to enter into the portion where the packing material 17 is disposed by the overlapped portion Y between the rear end 31 of the outer peripheral side plate 33 of the front cover 3 and the gradation portion 22 of the front end peripheral edge of the case main body 2, the rainwater is sealed by the overlapped portion Y, and the protection plate and the packing material 17, and the waterproof is enhanced.

[Others]

1. Although the present invention is applied to the boiler 1 for illustrative description in the above embodiment, the invention can also be applied to a hot water circulating heater for circulating hot water between a heating radiator disposed indoors.
2. In the above embodiment, the packing material 17 is covered with the rear end 31 of the front cover 3 to protect the packing material 17 from sunlight. Alternatively, a protection plate extending toward an outside of the packing material 17 may be brought into communication with the peripheral edge of the front end opening of the case main body 2, instead of the rear end 31.
3. If the top plate 23 of the case main body 2 is inclined rearward and downward as shown with phantom lines in FIG. 1, rain falling on the top plate 23 flows rearward, and this makes the rainwater more difficult to flow into the portion where the packing material 17 is disposed.

The invention claimed is:

1. A gas combustion apparatus having an outer case 10 accommodating a combustion apparatus main body having an exhaust collector 14 connected to an exhaust cylinder 15 therein, in which the outer case 10 comprises a case main body 2 of rectangular box shape with a front side opened, and a front cover 3 for closing a front end opening of the case main body 2, wherein the case main body 2 has an inner peripheral flange 20 formed on an inner peripheral edge of the front end opening of the case main body 2, the inner peripheral flange 20 extends inwardly from a top plate 23 of the case main body 2 at the front end opening, the front cover 3 has an opposite inner peripheral flange 39 formed on an inner peripheral edge of a rear end of the front cover 3, the opposite inner peripheral flange 39 extends inwardly from an upper side portion 33*a* of the front cover 3, so that when the front cover 3 is closed, the inner peripheral flange 20 and the opposite inner peripheral flange 39 are hidden under the upper side portion 33*a*, a waterproof packing material 17 is sandwiched between the inner peripheral flange 20 and the opposite inner peripheral flange 39, a protection plate formed at the upper side portion 33*a* of the front cover 3 covers from above a range extending along an upper edge of the front end opening of the case main body 2 of the packing material 17, the protection plate being flush with the top plate 23 of the case main body 2, wherein a tip end of the protection plate is disposed so as not to extend above the upper side portion 33*a* when the front cover 3 is closed.

2. The gas combustion apparatus according to claim 1, further comprising:

a wall of the front cover 3 having an opening 300 for receiving an exhaust cylinder 15;

a lower drainage receiver opening upward and having a drainage hole at a lower end thereof in an inner side of the front cover 3, an upper drainage receiver provided above the lower drainage receiver and below the opening 300 for the exhaust cylinder 15, the upper drainage receiver being formed in the form of a gutter whose upper portion is opened;

a visor member with slant posture to descend toward front is established above the upper drainage receiver and the opening 300, and below a range extending along the upper edge of the front end opening of the case main body 2 of the packing material 17, wherein a dripping water from the visor member drops into the lower drainage receiver through the upper drainage receiver.

3. The gas combustion apparatus according to claim 2, wherein the visor member is detachably inserted into the front end opening of the case main body 2.

4. The gas combustion apparatus according to claim 1, wherein an inner side of the front cover 3 is provided with a drainage receiver opening upward and having a drainage hole at a lower end thereof, a visor member with slant posture to descend toward front is established above the drainage receiver and below a range extending along the upper edge of the front end opening of the case main body 2 of the packing material 17, and a dripping water from the visor member drops into the drainage receiver.

5. The gas combustion apparatus according to claim 4, wherein the visor member is detachably inserted into the front end opening of the case main body 2.

6. The gas combustion apparatus according to claim 1, wherein the case main body 2 has gradation portion 22 fitted into the front cover 3 around the front end opening thereof.

* * * * *